US006332607B1

(12) United States Patent
Van Der Werff

(10) Patent No.: US 6,332,607 B1
(45) Date of Patent: Dec. 25, 2001

(54) APPARATUS AND METHOD FOR SEPARATING SHEETS FROM A STACK THAT INCLUDES A PULSED SUCTION ASSEMBLY

(75) Inventor: Jeichienus Adriaan Van Der Werff, Montfoort (NL)

(73) Assignee: Neopost B.V., Drachten (NL)

( * ) Notice: Subject to any disclaimer, the term of this patent is extended or adjusted under 35 U.S.C. 154(b) by 0 days.

(21) Appl. No.: 09/223,805

(22) Filed: Dec. 31, 1998

(30) Foreign Application Priority Data

Dec. 31, 1997 (NL) ..... 1007943

(51) Int. Cl.[7] ..... B65H 3/14

(52) U.S. Cl. ..... 271/101; 271/5; 271/100; 271/102; 271/107; 271/106; 271/108; 271/105

(58) Field of Search ..... 271/99, 5, 101, 271/100, 90, 107, 102, 105, 106, 108

(56) References Cited

U.S. PATENT DOCUMENTS

| | | | | |
|---|---|---|---|---|
| Re. 32,128 | * | 4/1986 | Blumle | 271/94 |
| 2,995,359 | * | 8/1961 | Gulick | 271/98 |
| 3,419,263 | * | 12/1968 | Weidman | 271/98 |
| 3,884,460 | * | 5/1975 | Jiruse | 271/98 |
| 4,127,262 | | 11/1978 | Eberle et al. . | |
| 4,184,672 | * | 1/1980 | Watkins et al. | 271/105 |
| 4,451,028 | | 5/1984 | Holmes et al. . | |
| 4,537,391 | * | 8/1985 | Watkiss et al. | 271/101 |
| 4,548,395 | * | 10/1985 | Snellman et al. | 271/99 |
| 4,591,140 | | 5/1986 | Illig et al. . | |
| 4,907,791 | * | 3/1990 | Higgins et al. | 271/5 |
| 5,106,070 | | 4/1992 | Reist . | |
| 5,116,040 | * | 5/1992 | Sauer | 271/101 |
| 5,441,249 | | 8/1995 | Todaro et al. . | |
| 5,704,607 | * | 1/1998 | Brotherseon | 271/96 |
| 5,707,056 | * | 1/1998 | Rauien et al. | 271/96 |
| 5,833,228 | * | 11/1998 | Nagata et al. | 271/11 |
| 6,145,829 | * | 11/2000 | Furmanski et al. | 271/11 |
| 6,264,188 | * | 7/2001 | Taylor et al. | 271/98 |

FOREIGN PATENT DOCUMENTS

| | | | |
|---|---|---|---|
| 637087 | | 7/1983 | (CH) . |
| 3404215 | | 8/1985 | (DE) . |
| 0417503 | | 3/1991 | (EP) . |
| 076222 | | 3/1997 | (EP) . |
| 0798247 | | 10/1997 | (EP) . |
| 829518 | | 3/1960 | (GB) . |
| 08315103 | * | 11/1996 | (JP) G06M/9/02 |
| 1002743 | | 3/1996 | (NL) . |

* cited by examiner

*Primary Examiner*—Donald P. Walsh
*Assistant Examiner*—Daniel K Schlak
(74) *Attorney, Agent, or Firm*—Burns,Doane, Swecker & Mathis, L.L.P.

(57) ABSTRACT

For individually separating outer sheets (9, 109) of a stack (6, 106) in a holder (1, 101), in each case in the area of an outer sheet or an outer set of sheets a suction is generated for sucking at least a portion of an outer sheet or set of sheets (9, 109) from an initial position, away from the stack, to a discharge position. From that discharge position a sheet or set of sheets is discharged away from the stack (6, 106) by a discharge structure engaging the sheet or set of sheets. The suction assembly (12, 112, 212) in each case generates a pulsed suction in a position spaced from the initial position. As a result, the sheets or sets of sheets can be reliably displaced one by one to the discharge position, while the intended operation of the apparatus is little sensitive to the suction strength set.

29 Claims, 8 Drawing Sheets

APPARATUS AND METHOD FOR SEPARATING SHEETS FROM A STACK THAT INCLUDES A PULSED SUCTION ASSEMBLY

FIELD AND BACKGROUND OF THE INVENTION

This invention relates to an apparatus and a method for individually separating outer sheets or outer sets of sheets of a stack.

Such an apparatus and such a method are known from Dutch patent specification 10 02743, In this known apparatus, the separation is carried out by placing a suction mouth against an outer sheet and thereupon creating a reduced pressure in the suction mouth. Thereupon the suction mouth is moved away from the stack, while the sheet, owing to the reduced pressure, is held against the suction nozzle and is thereby, at least locally, carried along. Thereafter, a separation element is brought between the sheet and the stack, which engages the sheet and separates it further from the stack and moves it away from the stack. Instead of sheets, sets of sheets can be separated, such as sets of sheets bound to form quires or booklets, or envelopes with sheets inserted in them.

To obtain a reliable operation in such a system, the reduced pressure needs to be set fairly accurately in accordance with the properties of the sheet or sets of sheets to be separated. This is objectionable in particular when the properties of the sheets within a stack or in different stacks vary. More particularly, the suction force must be strong enough to displace the sheet or the sets of sheets, but must not be so strong that suction is applied through the sheet, thereby causing a next sheet to be moved away from the stack as well, or that the outer sheet is damaged.

Further, the suction mouth, which, with a view to a proper sealing, must be made of pliable material, in each case touches the sheet to be separated. This limits the life of the suction mouth and sometimes causes prints on the outer sheet.

SUMMARY OF THE INVENTION

It is an object of the invention to obviate the problems described hereinabove and in particular to limit the sensitivity to the setting of the reduced pressure and to prevent the formation of prints on separated sheets.

According to the present invention, this object is achieved by designing an apparatus of the initially indicated kind with a holder with a support structure for holding the stack with an outer sheet or an outer set of sheets in a particular initial position; a suction assembly for generating, in the area of the initial position, a suction for sucking at least a portion of an outer sheet or an outer set of sheets of the stack, for displacing an outer sheet or an outer set of sheets from the initial position away from the stack to a discharge position; and a discharge structure for discharging a sheet or a set of sheets from the discharge position away from the stack, wherein the suction assembly is arranged for generating the suction in a pulsed manner in a position spaced from the initial position. Towards this object, the invention further provides a method of the initially indicated kind, wherein a suction for sucking at least a portion of an outer sheet or outer set of sheets in an initial position is generated, at least a portion of an outer sheet or an outer set of sheets is displaced from the initial position, away from the stack, and thereafter the sheet or set of sheets is discharged away from the stack by engagement of the at least partly displaced sheet or the at least partly displaced set of sheets, wherein the suction of air is carried out in a pulsed manner and from a position spaced from the initial position of the outer sheet or the outer set of sheets.

Owing to the provision of a suction assembly which, in a position spaced from the initial position of the stack of sheets or sets of sheets to be separated, draws in air in a pulsed manner, the outer sheet or the outer set of sheets, as a result of a pulsed air displacement in an area adjacent to the sheet or the set of sheets, is, at least locally, displaced to a discharge position. As a result, surprisingly, the displacement of the sheets to the discharge position has been found to be possible in a very reliable manner without the next sheet or the next set of sheets being essentially carried along, and to be relatively insensitive to the value of the reduced pressure and the amount of air displaced. Further, the suction assembly does not need to be displaced as much, if at all, and it does not need to touch the sheet or the set of sheets to be separated. Since air needs to be displaced only in a pulsed manner, the suction assembly can be of simple design and acoustic emissions in operation can be readily limited to a low level.

Further objects, embodiments and elaborations of the apparatus and the method according to the invention will be apparent from the following description, in which the invention is further illustrated and elucidated on the basis of a number of exemplary embodiments, with reference to the drawings.

DETAILED DESCRIPTION

First, the invention will be further elucidated on the basis of the exemplary embodiment of an apparatus according to the invention as shown in FIGS. 1–5. Thereafter, some particular alternative embodiments will be described.

Figure 1:
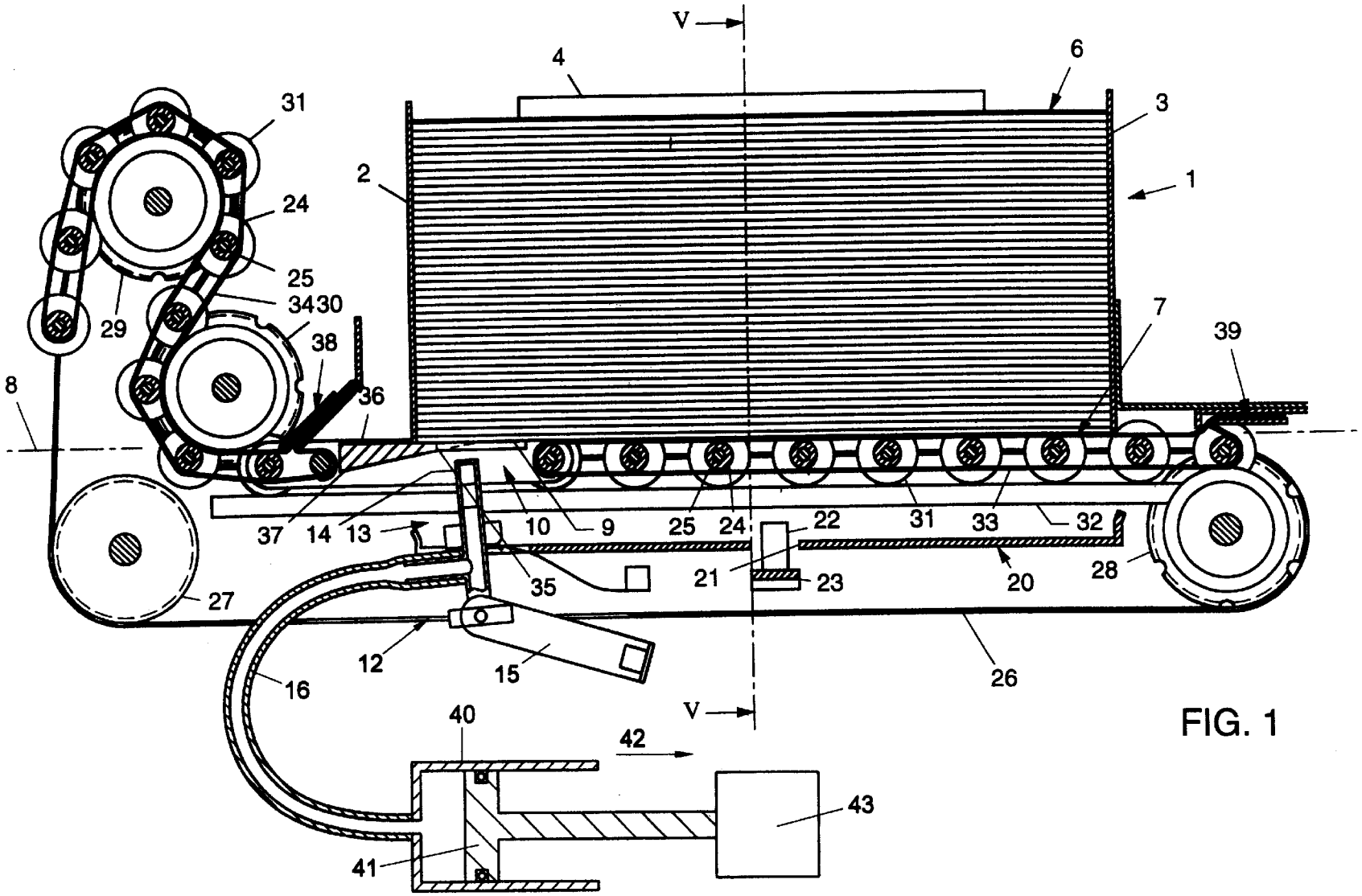
FIGS. 1–4 are sectional side elevations, taken on the line I—I in FIG. 5, of an apparatus according to a first exemplary embodiment of the invention in successive operative stages.
Figure 2:
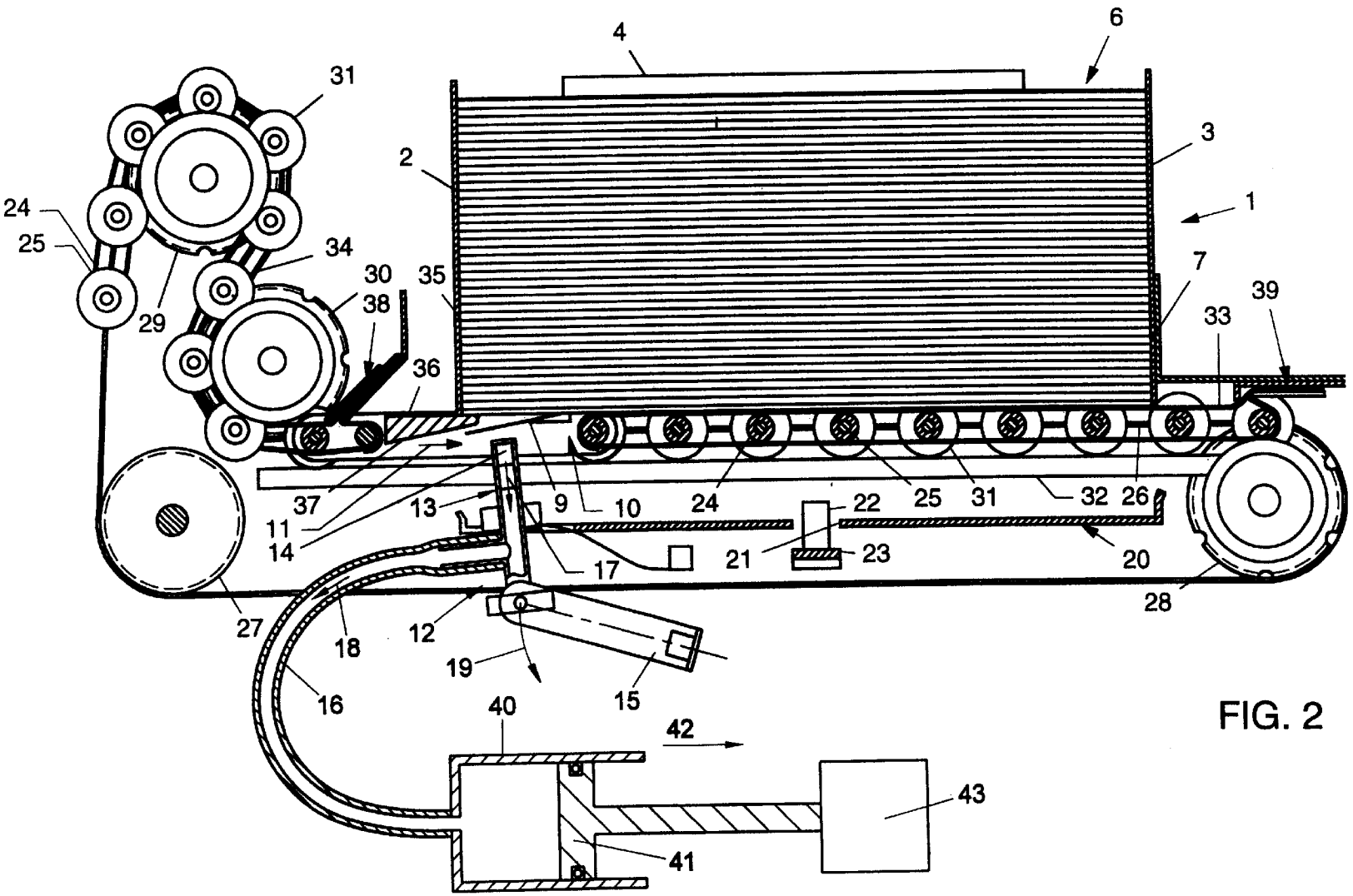
Figure 5:
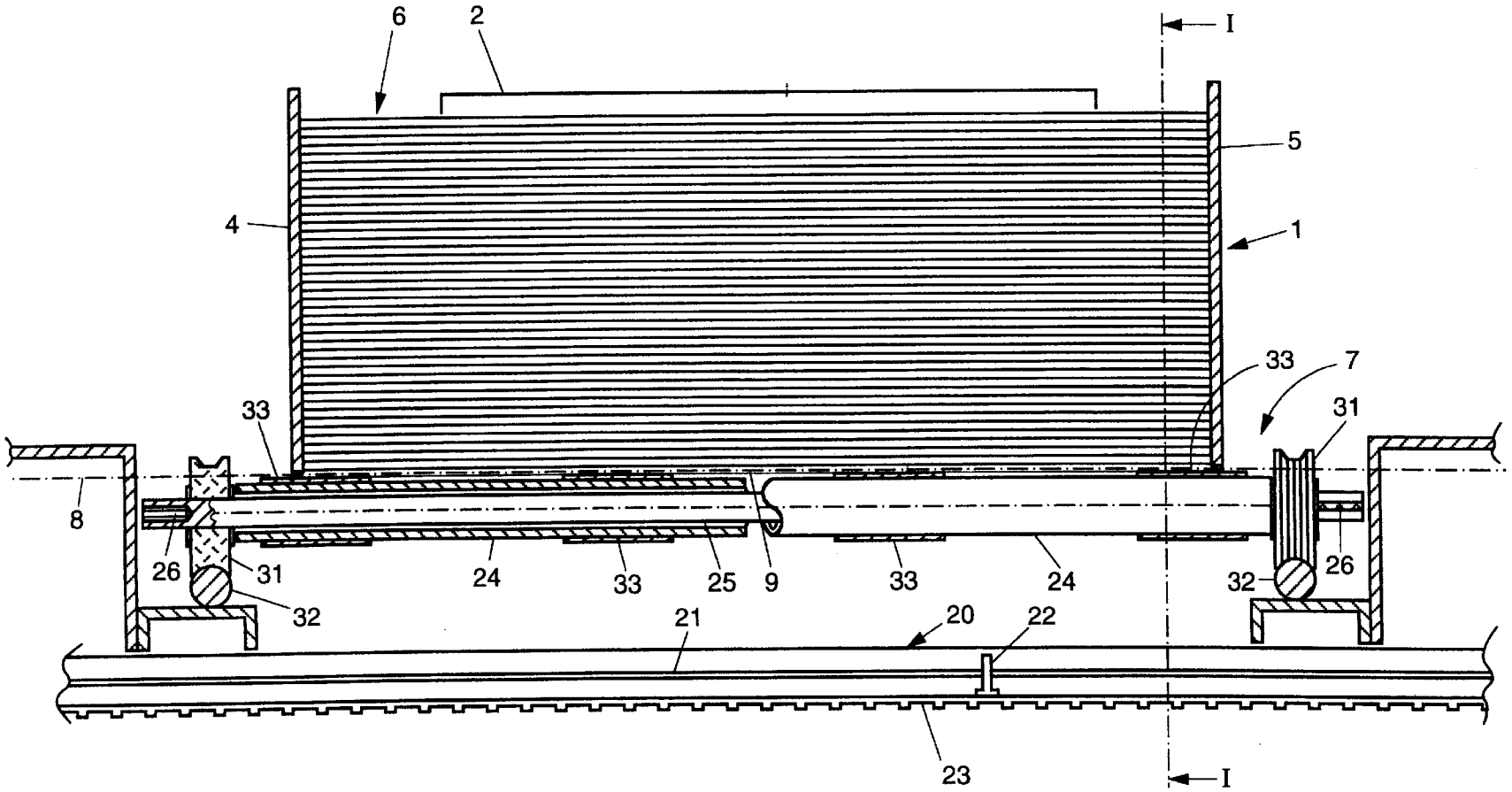
FIG. 5 is a cutaway sectional side elevation taken on the line V—V in FIG. 1, FIGS. 6 and 7 are side elevations, partly in section, of an apparatus according to a second exemplary embodiment of the invention in successive operative stages.

The apparatus shown in FIGS. 1 and 2 comprises a holder 1 with guides 2, 3, 4, 5 which form part of a support structure for keeping a stack of sheets 6 positioned, and with an abutment structure 7 which defines an abutment plane 8 (see FIG. 1 and FIG. 5). The stack 6 in the holder 1 has an outer (lowermost) sheet 9 in an initial position against the abutment structure 7, the abutment structure 7 forming the bottom of the holder 1, on which the stack rests. The abutment structure 7 is provided with a slit 10 for allowing a sheet 9 to pass. The slit 10 is movable along the abutment plane 8 relative to the guides 2, 3, 4, 5 that keep the stack 6 in place, in a direction transverse to the slit, indicated in FIG. 2 with an arrow 11. Further, the slit 10 is movable in the opposite direction to return it to its initial position shown in FIGS. 1 and 2.

In the area of the position of the initial position of the slit 10, a suction assembly is arranged, which, in this example, is designed with a picker 12. The picker 12 is arranged an a side of the abutment plane 8 remote from the holder 1 and is positioned and arranged for displacing a corner or edge portion of an outer sheet 9 or of an outer set of sheets of a stack 6 in the holder 1 into the slit 10 located in a particular position through pulsed suction of air.

The picker 12 further comprises a nozzle 13 provided with a suction opening 14 which forms the picker head for sucking outer sheets or sets of sheets into the slit. The suction assembly further comprises a flexible duct 16 and a piston/cylinder combination 40. The nozzle 13 is suspended by means of a pivoting arm 15 for reciprocation between a first position (FIGS. 3 and 4) remote from the abutment structure 7, and a second position, projecting into the slit 10, spaced from the initial position of the outer sheet 9 (FIGS. 1 and 2). On its side remote from the suction opening 14, the nozzle 13 is connected to a flexible duct 16 which in turn communicates with the piston/cylinder combination 40 which is provided with an operating mechanism 43. By a quick movement of the piston 41 in the direction indicated by arrow 42 in FIG. 1, a pulsed suction through the suction opening 14 can be generated via the flexible duct 16 and the nozzle 13.

In operation, the condition shown in FIG. 1 forms an initial situation, in which the slit 10 is in a first, extreme position. In that initial situation, the stack 6 is supported on the abutment structure 7, with the lowermost sheet 9 supported on either side of the slit 10 by surfaces of the abutment structure 7 that face the inside of the holder 1. To facilitate the displacement of an outer sheet or set of sheets away from the stack, it is also possible to support the stack only along one edge of the slit, so that the free edge or corner of an outer sheet of an outer set of sheets projects freely above the slit 10 and can be readily bent into the slit.

A quick movement of the piston 41 in the direction of arrow 42 provides that, via the nozzle 13 and the flexible duct 16, pulsed suction of air is generated, as is represented in FIG. 2 by arrows 17, 18. As a result, the outer sheet 9 is locally sucked away from the Stack 6 into a discharge position, projecting into the slit 10, as appears from FIG. 2.

The edge portion of an outer sheet or an outer set of sheets 9 is thus brought into the slit 10 by sucking it into the slit 10 with the aid of a pulsed suction. In each case, only the outer sheet or the outer set of sheets is subject to suction, without the next sheet or the next set of sheets being essentially carried along, so that it is ensured in a simple manner that in each case only the outer sheet or the outer set of sheets is brought into the slit 10. Since for the suction of the outer sheet or the outer set of sheets, it suffices to provide a suction opening 14 through which the air is drawn in a pulsed manner, the apparatus is constructionally simple.

Figure 3:
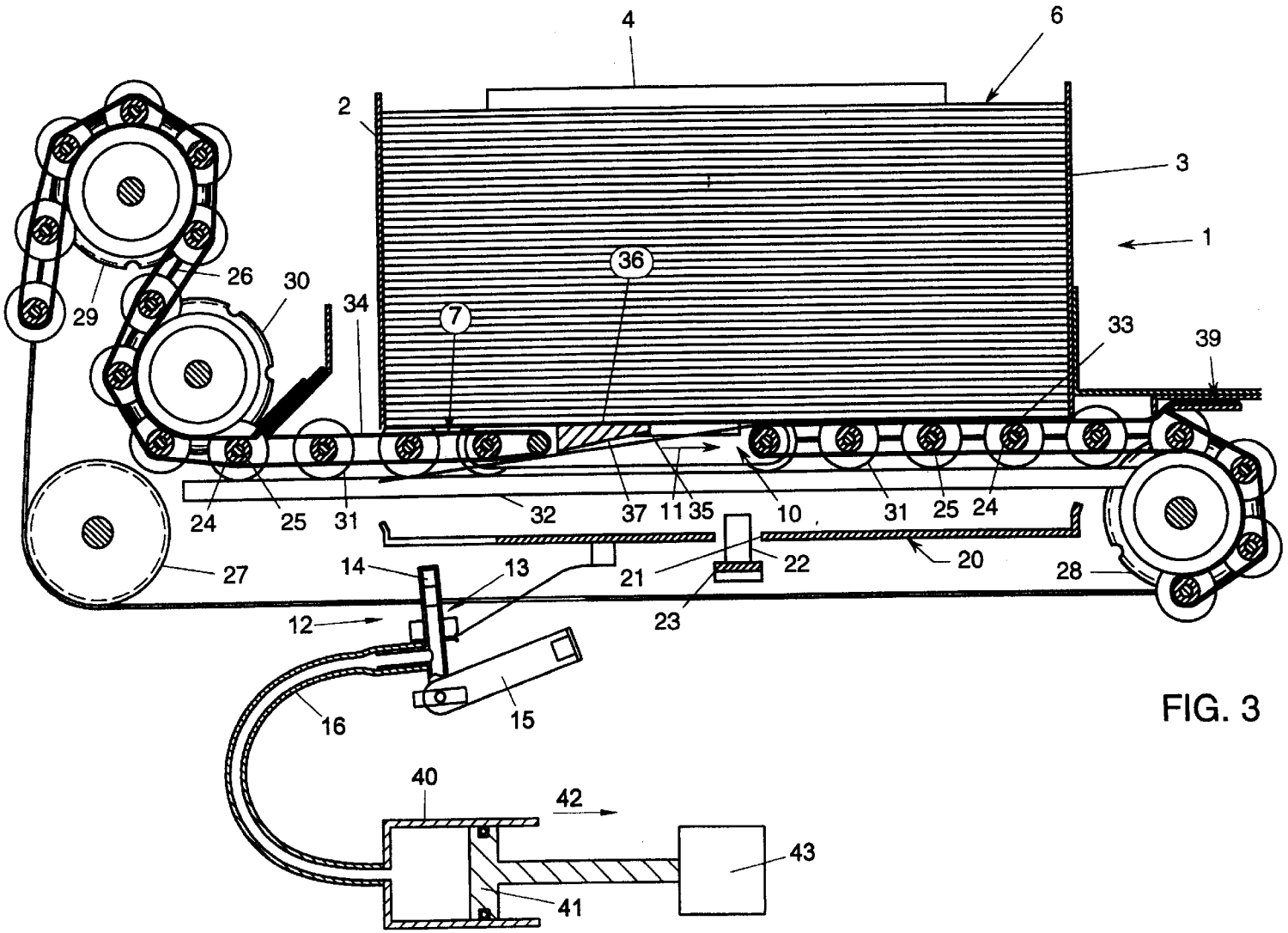

After the edge portion of a sheet 9 has been brought into the slit 10, the arm 15 is pivoted, so that the nozzle 13 is brought to the position remote from the abutment plane 8, represented in FIG. 3.

Figure 4:
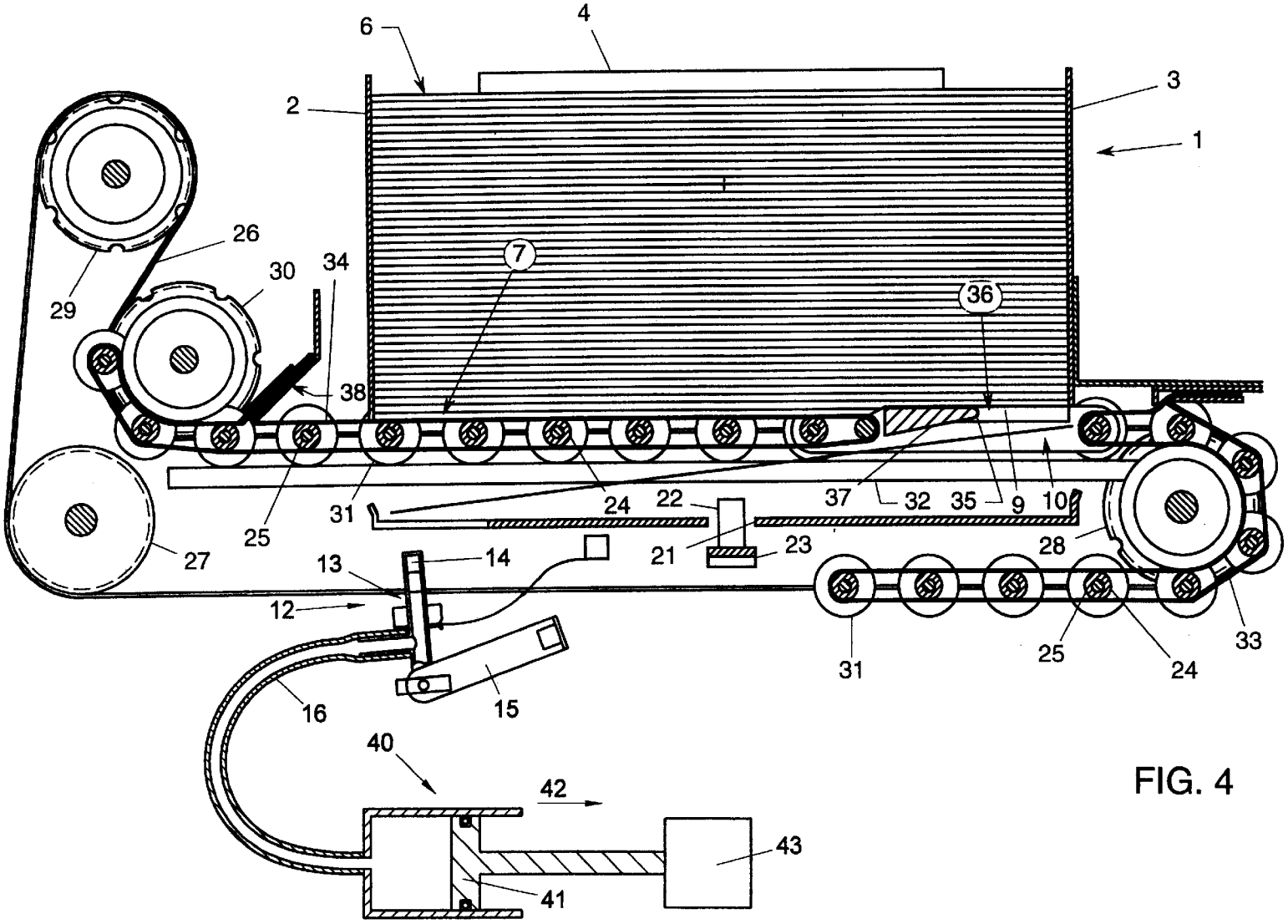

Further, the slit 10 is directly displaced along the abutment plane 8 in a direction transverse to the longitudinal direction of the slit 10, as is indicated with the arrows 11 (see FIGS. 2 and 3). The sheet is thereby prevented from springing back into its initial position again and the outer sheet 9 then passes through the slit 10, until the position represented in FIG. 4 is reached, in which the formerly outer sheet is entirely clear of the stack 6. A next sheet 9 then forms the outer sheet of the stack 6. Through a suitable coordination of the movements of the slit 10 and of the control mechanism 43 of the piston/cylinder combination 40 it is then accomplished that the movement of the slit 10 occurs precisely at the moment when, through the pulsed suction of the suction assembly, the edge portion of the outer sheet 9 or outer set of sheets has been sucked into the discharge position projecting into the slit 10.

From the condition represented in FIG. 4, once the outer sheet 9 or the outer set of sheets is clear of the slit 10, the slit 10 and the arm 15 are moved back to the positions represented in FIG. 1, the arrangement being such that the nozzle 13 does not butt against the returning abutment structure 7.

In the method of which successive stages are represented in FIGS. 1–4, in each case, by a single suction pulse, a single outer sheet or a single outer set of sheets is sucked from an initial position, away from the stack, and displaced to the discharge position, whereafter the sheet or the set is discharged further and the separation is effected. Thereafter, the next sheet or set of sheets is separated. Thus, in each case, a sheet or set of sheets is peeled off the underside of the stack 6, without the sheet needing to be shifted relative to other sheets as it passes through the slit 10. As a result, sheets or sets of sheets can be separated from the stack 6 without being hindered by friction between sheets to be separated from each other. In separating sets of sheets, such as booklets or sets of sheets stapled together, each set is preferably brought into the slit 10 with a bound edge or corner in leading position, while the pulsed suction occurs in the proximity of the edge or corner, so that in a simple manner and with a high degree of reliability in each case exactly one set can be brought into the slit 10.

For displacing a sheet or a set of sheets to the discharge position, the value of the required reduced pressure and the amount of displaced air is little dependent on the kind of sheets to be separated. As a consequence, with a single setting of the suction pulse, a large variety of kinds of sheets or sets of sheets can be separated. This is favorable in particular if the stack to be separated consists of different kinds of sheets or sets of sheets.

For discharging separated and dispensed sheets, under the holder 1 a transport path is arranged. This transport path is formed by a guide chute 20 which is provided with a slot 21, through which reach transport fingers 22. The transport fingers 22 project from a toothed belt 23, extending under the chute 20, through the slot 21, and can advance through this chute 20 separated sheets and sets of sheets which have fallen into this chute.

The abutment structure 7 comprises rollers, of which, for the sake of clarity, only a few have been indicated with a reference numeral 24, which rollers 24 are rotatably suspended for rolling along the path of movement of the slit 10 along an outer sheet 9 of the stack 6 in the holder 1.

The rollers 24 are held at a fixed mutual distance in that they are mounted on pins 25 attached with a constant mutual spacing to circulating pulling means in the form of belts 26.

These belts 26 pass over return rollers 27, 28. In order to prevent the path along which the rollers 24 are movable the side of the return rollers 27, 28 remote from the holder 1 intersecting the picker 12, two additional divert rollers 29, 30 are arranged between the holder 1 and the return roller 27 located closest to the picker 12. These divert rollers 29, 30 increase the total length of the circulating belts 26 between the holder 1 and the picker 12 without this entailing a substantial enlargement of the area occupied by the apparatus.

For supporting the pins 25 in the area where the stack 6 abuts against the abutment structure 7 and for providing a low-friction movability of the abutment structure 7 with the slit 10, the pins 25 are bearing-mounted in wheels 31 adapted to ride over rails 32. These rails 32 extend on opposite sides under the area where the stack 6 abuts against the abutment structure 7.

For obtaining a uniform support of the stack and in order to avoid edge portions of outer sheets curling and ending up between the rollers 24, the apparatus according to FIGS. 1–5 is provided with flexible pulling elements 33, 34 each extending on one side of the slit 10 over circumferential portions proximal to the abutment plane 8 of a number of the rollers 24, and are designed as belts. Optionally, a single belt can suffice, which then preferably has a width at least covering a large part of the width of the abutment structure 7. However, the pulling elements can also be designed as cords.

The belts 33, 34 each extend from an anchorage 38 and 39, respectively, operatively fixed with respect to the guides 2, 3, 4, 5 and each located on the same side of the path of the rollers 24 as the holder 1. In the apparatus according to the present example, this path is defined by the paths of the circulating belts 26 to which the pins 25 bearing the rollers 24 are attached with mutual interspaces. These measures prevent portions of the belts 33, 34 that are operatively in contact with the stack 6 from shifting relative to the stack 6, which might lead to documents getting damaged or clamped between the guides 2, 3, 4, 5 and the abutment structure 7.

The portions of the belts 33, 34 extending through the slit 10 away from the holder 1 could be guided in many directions. In order to obtain a compact and simple construction, the belts 33, 34 are designed as loops running along the rollers 25 on a side remote from the abutment plane 8 likewise to the anchorages 38, 39 operatively fixed with respect to the guides 2, 3, 4, 5. In the apparatus shown, this is realized in a constructionally simple manner in that the belts 33, 34 pass along all rollers 25 on the relevant side of the slit 10, so that the extreme rollers 25 located remote from the slit 10 at the same time constitute return rollers for the belts 33, 34.

The apparatus according to the example shown in FIGS. 1–5 further comprises a lead-in edge 35 along one side of the slit 10. This lead-in edge is considerably narrower than the diameter of the rollers 25 and is connected to a support surface 36 and a guide surface 37 which diverge away from the lead-in edge 35. By virtue of this relatively narrow lead-in edge 35, an outer sheet 9 only needs to be bent away from the rest of the stack 6 over a very minor distance to make it possible to introduce the portion of the abutment structure 7 that follows the slit 10 between that sheet 9 and the rest of the stack 6. Moreover, by virtue of the guide surface 37 contiguous to the lead-in edge 35 and gradually diverging from the abutment plane 8, a sheet or a set of sheets passing through the slit needs to be bent only to a slight extent. As a result, processing relatively bending-stiff kinds of paper and other materials, as well as relatively thick sets of sheets, such as books of a thickness such as that of, for instance, an average annual report (4–5 mm and more), is also possible without any problems.

If the stack to be separated consists of paper sheets of a current thickness (such as 60- to 140-gram paper) which have a width dimension in the range of 15 to 25 cm and a length dimension in the range of 25 to 35 cm, such as the widely used paper sizes A4 and folio, then it is effective that the volume of air in each case drawn in by pulsed suction is at least 30 $cm^3$ and preferably 50–150 $cm^3$, more particularly 80–100 $cm^3$;. For other kinds of sheets, or the sets of sheets having a higher or lower bending stiffness, the minimum amount of air required for an effective suction of the sheets is higher and lower, respectively. For separating sheets of different kinds, the suction volume required for the most bending-stiff kind is generally determinative. Using that volume, the more flexible kinds can normally be sucked without any problems.

For adjusting the apparatus to sheets and sets of sheets of different stiffness, the distance between the abutment structure and the suction assembly 12, or at least the suction mouth 14, is preferably adjustable. In the apparatus according to this example, this can be achieved by adjusting the position of the separation element 36 with respect to the opposite edge of the slit.

It is preferred that the duration of the suction pulse is shorter than 0.3 s. More particularly, it is preferably between 0.02 and 0.2 s. In practice, especially a pulse duration between 0.03 and 0.07 s yields good results. A short suction duration is favorable for the efficiency of the separation process. In addition, the duration of the suction pulse depends on the time needed to suck the outer sheet or the outer set of sheets into the discharge position and the time needed for the discharge element to discharge the sheet or set of sheets disposed in the discharge position. An embodiment of the invention which is currently preferred most is designed as a so-called bottom-feeder, as depicted in FIGS. 6 and 7.

Figure 6:
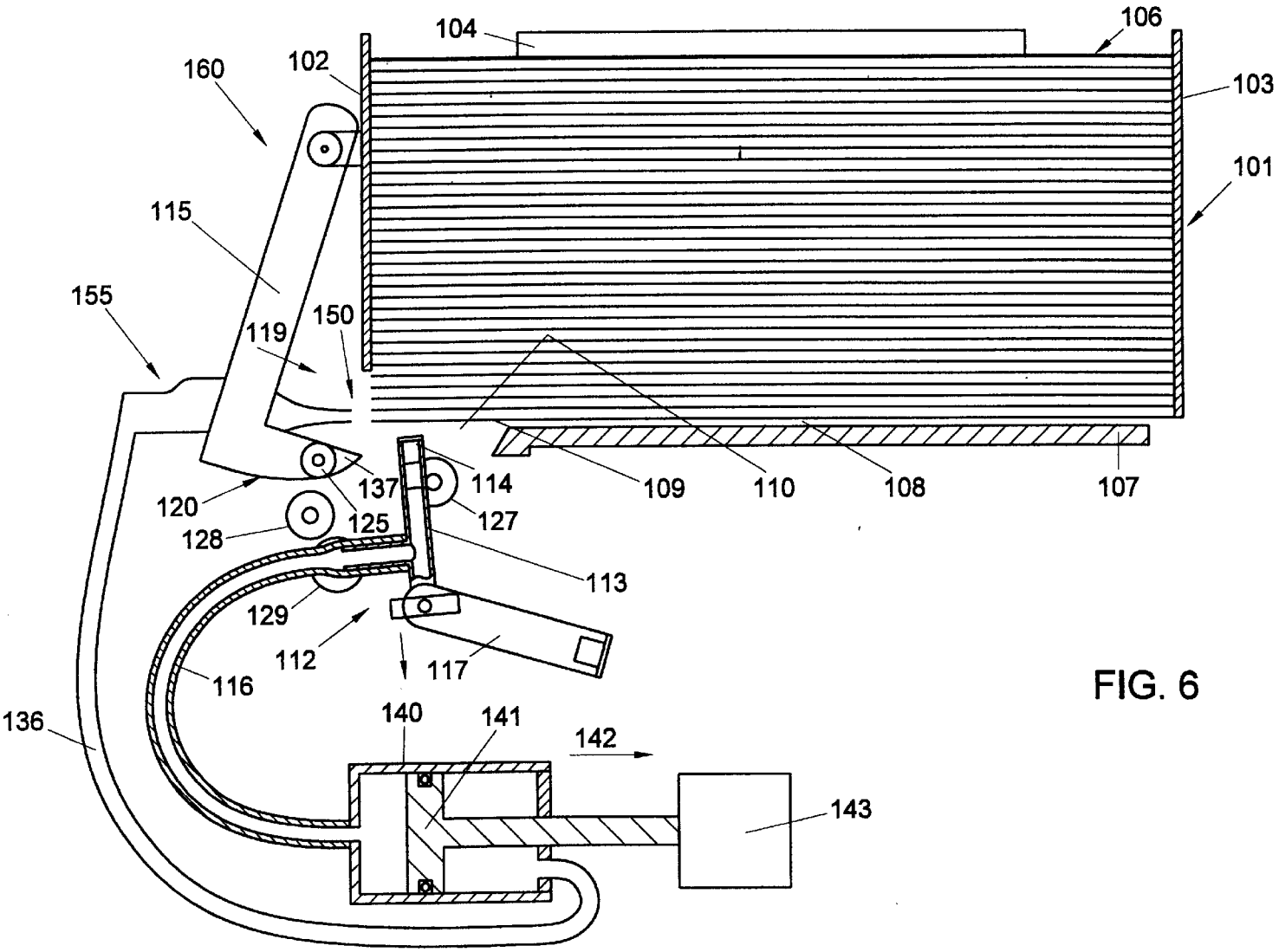
Figure 7:
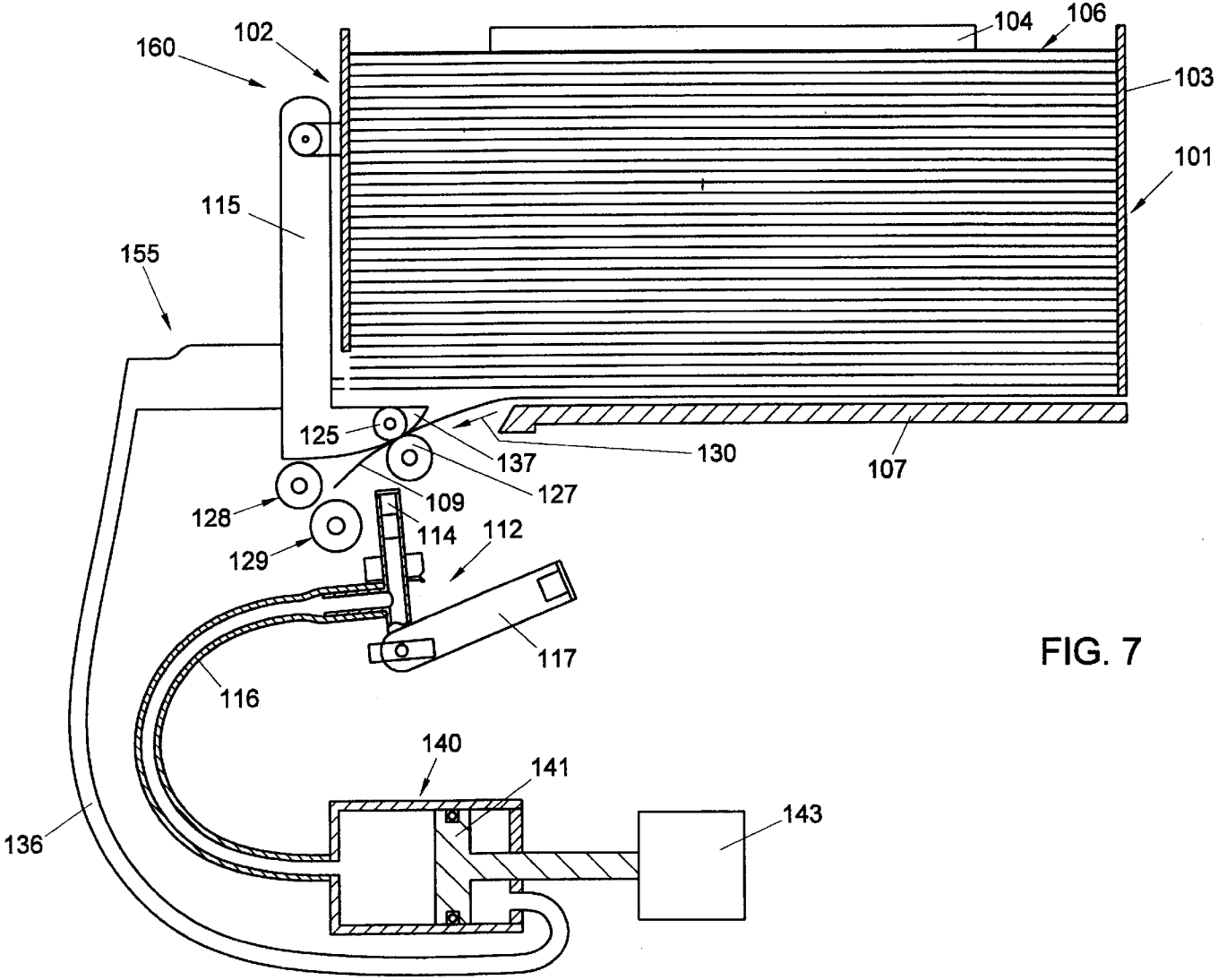

The apparatus shown in FIGS. 6 and 7 comprises a holder 101 with guides 102, 103 and 104, which form part of a support structure for holding a stack of sheets 106 in position, and includes an abutment structure 107 which defines an abutment plane 108 (see FIG. 6). The stack 106 in the holder 101 is retained with an outer sheet 109 against the abutment structure 107 in an initial position, in that the abutment structure 107 forms the bottom of the holder 101, on which the stack 106 rests. The abutment structure 107 is provided with an opening 110 for allowing a sheet 109 to pass.

The holder 101 further comprises a suction assembly with a picker 112, and a discharge structure 160. Further provided is a blowing assembly 155 with a slit-shaped blowing mouth 150 which faces an edge of the stack 106, with the blowing mouth 150 arranged next to the discharge structure. The picker 112 is arranged on a side of the abutment plane 108 remote from the holder 101.

The picker 112 further comprises a suction line 113 which, on a side proximal to the initial position, is provided with a suction opening 114, and communicates on the other side via a flexible duct 116 with a cylinder/piston combination 140, of which a piston unit 141 is coupled to a drive 143 for pulsed suction of air by displacement of the piston 141 in a direction indicated by an arrow 142.

The discharge structure 160 is made up of a transport roller 127, a transport roller pair 128/129, and a hinged arm 115 provided with a discharge head 120 which is provided with a rotatably mounted roller 125. The transport rollers 127, 128, 129 are fitted with a drive assembly (not shown) by which they can be rotated. The rollers 125, 127, 128, 129 are coated with a resilient layer, for instance rubber, in a manner known per se, so that sufficient frictional forces can be generated between the rollers and the sheets of the stack.

In operation, by quickly displacing the piston 141 in the direction of the arrow 142; via the duct 116 and the fixed suction line 113, in a pulsed manner, air is drawn in through the suction opening 114, so that on the outside of the outer sheet 109 of the stack 106 a reduced pressure is created. As a result, a portion of the sheet 109 is moved away from the stack 106 through the opening 110 in the direction of the suction opening 114 and a space is created between the partly displaced outer sheet 109 and the other sheets of the stack 106.

The cylinder/piston combination 140 is of a double-acting type, where the cylinder is closed on the side of the piston 141 remote from the suction line, so that on that side of the piston, too, a chamber is located. This chamber communicates via a blowing line 136 with the blowing assembly 155. As a result, through one and the same movement of the piston, simultaneously both a suction pulse and a blowing pulse are generated.

Simultaneously with the suction pulse, an excess pressure is generated by the cylinder/piston assembly 140. As a result, an air stream is produced which flows through the blowing mouth 150 against the stack of sheets 106. In the neighborhood of a portion of the outer sheet 109, an excess pressure is created which supports the bending of an outer sheet, Although in this example the blowing air stream too is pulsed, it is also possible to have the blowing assembly blow continuously. A slit-shaped blowing mouth as used in this example is advantageous for a concentering blowing action, but other forms can also yield useful results.

After the outer sheet 109 has been displaced to the discharge position, the arm 115 is pivoted towards the stack 106 (arrow 119). The roller 125 is thereby brought between the outer sheet 109, disposed in the discharge position, and the stack 106, and opposite the drive roller 127 on the other side of the sheet 109. Also, the suction assembly is pivoted away from the stack by means of the pivoting arm 117 to avoid collision with the arm 115. The situation thus achieved is depicted in FIG. 7. It is noted that the arm 115 has a pointed nose 137 projecting towards the stack 106. As a result, a narrow gap between an outer sheet of a stack and the stack already suffices to bring the nose 137 and then the roller 125 between the stack 106 and the sheet 109 to be separated.

It is also possible for the suction opening to be placed so as to be staggered perpendicularly to the plane of the drawing with respect to the arm 115. This can then be mounted fixedly, which entails a constructional simplification.

The outer sheet 109 is clamped between the rollers 125 and 127. By activating the drive assembly of the drive roller 127, it is rotated and the sheet 109 is pulled away from the stack 106 in the direction of the arrow 130, the tensile force produced by the engagement of the drive roller 127 being greater than the frictional forces sustained by the surface of the sheet 109 from the abutment surface 107 and the rest of the stack. During the transport, the edge of the sheet 109 reaches the roller pair 128/129, which is rotated by the drive mechanism and transports the sheet 109 further.

After the sheet 109 has been removed in its entirety from the stack, the arm 115 and the picker 112 swing back again to the initial position, as depicted in FIG. 6, so that again an outer sheet can be separated from the stack.

To adjust the distance between the abutment structure 107 and the suction opening 114 of the suction structure to the extent to which the freely overhanging portion of an outer sheet hangs down and bends further upon suction, the position of the abutment structure 107 transverse to the slit 110 and along the stack 106 is adjustable.

Although in this exemplary embodiment reference has been made to the separation of single sheets, this embodiment too can be used for separating sets of sheets, even if the stack comprises different kinds of sheets and sets of sheets. This is true in particular of sets of sheets bound to form quires or booklets or sets of sheets packed in envelopes.

By having suction take place through a suction opening, which may or may not be movable between two positions, the apparatus can be optimally adjusted to specific circumstances, such as installation space and the like.

In the first and second exemplary embodiment, the suction assembly is designed with a cylinder/piston combination. However, other constructions may be used as well, such as, for instance, a vacuum source which communicates intermittently with the suction opening via a controllable valve.

It is effective to provide the apparatus with control means for activating the discharge element for discharging a sheet or a set of sheets in each case after the beginning and preferably after the end of a suction pulse. This can contribute towards setting an advantageous operating condition and in particular prevent a sheet that is being discharged from being retained by suction.

Figure 8:
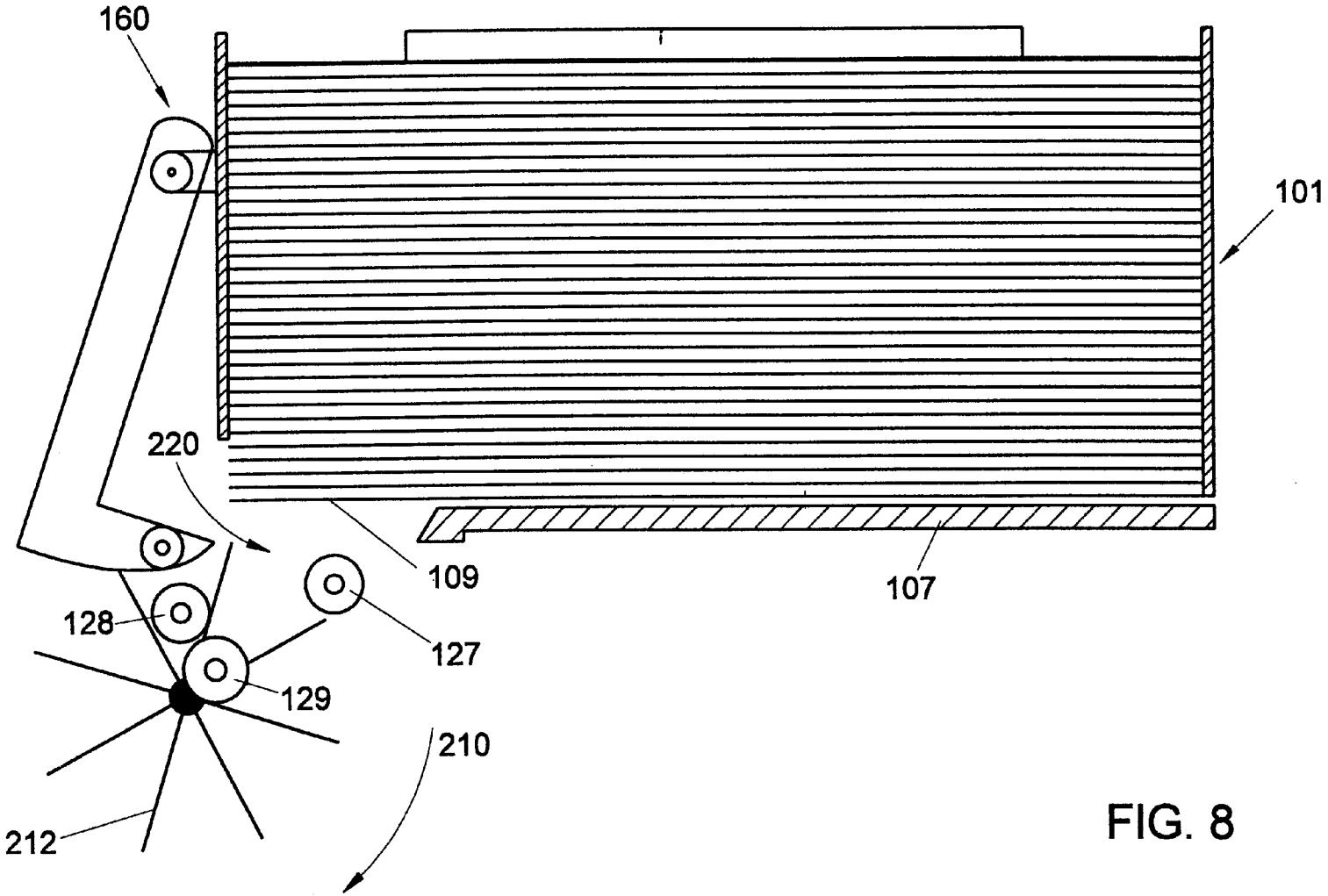
FIG. 8 is a side elevation, partly in cross section, of an apparatus according to a third exemplary embodiment of the invention.

According to a third exemplary embodiment, the suction and blowing assemblies are designed as a blade movable along the initial position, as shown in FIG. 8, The parts that correspond with the second exemplary embodiment have been numbered accordingly and detailed discussion thereof is omitted for the sake of brevity. The holder 101 is provided with an abutment surface 107 and with a discharge structure 160 equal to that of the second exemplary embodiment. Next to the separation element 160, a wheel 212 provided with a series of blades in radial direction is rotatably mounted, which can move step by step in the direction indicated by the arrow 210. By turning the wheel 212 abruptly, for instance through an angle of 45–360°, or through an angle corresponding with the angle between two successive blades, a pulsed air flow is generated in the direction indicated with arrow 220, which causes a reduced pressure on the underside of the outer sheet 109, and further an air stream in the direction of the initial position, so that the outer sheet is sucked from the initial position, away from the stack, to the discharge position. Discharging and separating the outer sheet which has been brought into the discharge position in this manner subsequently occurs in the same manner as has been described in conjunction with the second exemplary embodiment. In this way, with simple means, the pulsed suction as well as the blowing action can be realized. Although in this example the moving blade is used for both suction and blowing, the blade can also be used for suction or blowing alone. Further, instead of a blade wheel, a reciprocable blade or an air displacement element movable along a special path can be used.

What is claimed is:

1. An apparatus for individually separating outer sheets or outer sets of sheets of a stack, comprising:

a holder with a support structure for holding the stack stacked in a stacking direction with an outer sheet or an outer set of sheets in a particular initial position, a suction assembly for generating, in the area of said initial position, a suction for applying suction to at least a portion of the outer sheet or outer set of sheets of the stack, for displacing said at least one portion of said outer sheet or said outer set of sheets from said initial position away from the stack to a discharge position, and a discharge structure for discharging a sheet or a set of sheets from said discharge position away from the stack, wherein the suction assembly generates said suction in a pulsed manner and includes a suction opening via which the suction is applied in a position spaced from said initial position only, said suction opening being reciprocably movable between two positions at different distances from said initial position in the stacking direction.

2. An apparatus according to claim 1, further comprising a suction opening for sucking air in a position spaced from said initial position.

3. An apparatus according to claim 2, wherein the suction opening is mounted at a fixed position with respect to said initial position.

4. An apparatus according to claim 1, wherein a minimum distance in operating condition between the suction opening and said initial position is adjustable between at least two values.

5. An apparatus according to claim 1, wherein the suction assembly is arranged for generating a suction pulse shorter than 0.3 s.

6. An apparatus according to claim 1, wherein the suction assembly is arranged for sucking minimally 30 $cm^3$ of air per suction pulse.

7. An apparatus according to claim 1, further comprising control means for activating the discharge structure for discharging a sheet or a set of sheets in each case after the beginning of a suction pulse.

8. An apparatus according to claim 1, further comprising control means for activating the discharge structure for discharging a sheet or a set of sheets in each case after the end of a suction pulse.

9. An apparatus according to claim 1, further comprising a pressing structure for pressing the outer sheet or the outer set of sheets locally against the stack, at a position spaced from said suction assembly.

10. An apparatus according to claim 9, wherein said distance between the suction assembly and the pressing structure is adjustable.

11. An apparatus for individually separating outer sheets or outer sets of sheets of a stack, comprising a holder with a support structure for holding the stack with an outer sheet or an outer set of sheets in a particular initial position, a suction assembly, including a suction opening, for applying, in the area of said initial position, suction in a pulsed manner via the suction opening to at least one portion of the outer sheet or outer set of sheets of the stack for displacing said at least one portion of said outer sheet or said outer set of sheets from said initial position away from the stack to a discharge position, and a discharge structure for discharging a sheet or a set of sheets from said discharge position away from the stack, wherein the suction assembly generates said suction in a pulsed manner in a position spaced from said initial position only, and wherein the suction assembly has a chamber which has a volume which is variable in a pulsed manner between at least two volumes and which communicates with the suction opening.

12. An apparatus according to claim 11, wherein the suction assembly comprises a cylinder/piston combination.

13. An apparatus for individually separating outer sheets or outer sets of sheets of a stack, comprising:

a holder with a support structure for holding the stack with an outer sheet or an outer set of sheets in a particular initial position, a suction assembly for generating, in the area of said initial position, a suction for applying suction to at least one portion of the outer sheet or outer set of sheets of the stack, for displacing said at least one portion of said outer sheet or said outer set of sheets from said initial position away from the stack to a discharge position, and a discharge structure for discharging the sheet or set of sheets from said discharge position away from the stack, wherein the suction assembly generates said suction in a pulsed manner in a position spaced from said initial position only, and wherein the holder is arranged for holding the stack stacked in a stacking direction, the apparatus further comprising:

a separation element displaceable between a starting position outside the stack in the holder and a separation position at least partially in the stack or located below the stack in the stacking direction, said separating element in said separation position being at least partially located between said stack and said at least one portion of said outer sheet or said outer set of sheets displaced away from the stack, a drive for carrying out said displacement of the separation element, and control means for actuating said drive for carrying out said displacement in each case after the beginning of a suction pulse.

14. An apparatus according to claim 13, wherein the separation element carries a discharge element.

15. An apparatus for individually separating outer sheets or outer sets of sheets of a stack, comprising:

holder with a support structure for holding the stack with an outer sheet or an outer set of sheets in a particular initial position, a suction assembly for generating, in the area of said initial position, a suction for applying suction to at least one portion of the outer sheet or outer set of sheets of the stack, for displacing said at least one portion of said outer sheet or said outer set of sheets from said initial position away from the stack to a discharge position, a blowing assembly for generating an air stream which is directed towards said initial position, and a discharge structure for discharging the sheet or set of sheets from said discharge position away from the stack, wherein the suction assembly is arranged for generating said suction in a pulsed manner in a position spaced from said initial position only.

16. An apparatus according to claim 15, wherein the suction assembly forms part of the blowing assembly.

17. An apparatus according to claim 15, wherein the blowing assembly has a blowing opening which is provided with at least one slit-shaped blowing mouth.

18. An apparatus according to claim 15, wherein the blowing assembly comprises a blade movable along the initial position.

19. A method for individually separating outer sheets or outer sets of sheets of a stack, comprising:

applying suction via a suction opening connected to a suction assembly to at least one portion of an outer sheet or outer set of sheets in an initial position, displacing said at least one portion of the outer sheet or the outer set of sheets from said initial position, away from the stack, engaging the displaced at least one portion of the outer sheet or outer set of sheets with a discharge structure, and discharging said outer sheet or set of outer sheets engaged by said discharge structure away from the stack, wherein the suction of air is carried out in a pulsed manner and from a position in which said suction opening is spaced from said initial position of the outer sheet or the outer set of sheets only, and said suction being generated by varying a volume of a chamber of said suction assembly in a pulsed manner between at least two volumes, said chamber communicating with the suction opening.

20. A method according to claim 19, wherein the discharge is started in each case after the beginning of a suction pulse.

21. A method according to claim 19, wherein the discharge is started in each case after the end of a suction pulse.

22. A method according to claim 19, wherein the suction pulses last shorter than time intervals between them.

23. A method according to claim 19, wherein the suction pulses last shorter than 0.3 s.

24. A method according to claim 19, wherein per suction pulse a volume of air of minimally 30 $cm^3$ is drawn in.

25. A method according to claim 19, wherein the outer sheet or the outer set of sheets is pressed against the stack at a point spaced from the area where suction of air takes place.

26. A method according to claim 25, wherein said distance between the area where suction of air takes place and where the outer sheet or the outer set of sheets is pressed against the stack is set differently for separating different kinds of sheets.

27. A method for individually separating outer sheets or outer sets of sheets of a stack, wherein the stack is stacked in a stacking direction, comprising:

applying a suction pulse to at least one portion of an outer sheet or outer set of sheets in an initial position, displacing said at least one portion of said outer sheet or said outer set of sheets from said initial position, away from the stack, displacing a separation element after the beginning of the suction pulse from a starting position outside the stack in the holder to a separation position at least partially in the stack or displaced below the stack in the stacking direction, said separation element in said separation position being located between said stack and said at least one portion of said outer sheet or said outer set of sheets displaced from said initial position, engaging the displaced at least one portion of the outer sheet or outer set of sheets with a discharge structure, and discharging said sheet or set of sheets engaged by said discharge structure away from the stack, wherein the suction pulse is applied from a position spaced from said initial position of the outer sheet or outer set of sheets only.

28. A method for individually separating outer sheets or outer sets of sheets of a stack, comprising:

applying a suction pulse to at least a portion of an outer sheet or outer set of sheets in an initial position, displacing said at least one portion of said outer sheet or outer set of sheets from said initial position, away from the stack, engaging the displaced at least one portion of the outer sheet or outer set of sheets with a discharge structure, and discharging said sheet or set of sheets engaged by said discharge structure away from the stack, wherein the suction pulse is applied from a position spaced from said initial position of the outer sheet or outer set of sheets only, wherein said stack is stacked in a stacking direction, wherein a suction opening via which said suction pulse occurs is reciprocated between a position near the stack and a retracted position more remote in said stacking direction from said stack, and wherein the suction is started in each case after said position near the stack has been reached.

29. A method for individually separating outer sheets or outer sets of sheets of a stack, comprising:

applying suction in a pulsed manner to at least a portion of an outer sheet or outer set of sheets in an initial position, displacing said at least one portion of said outer sheet or outer set of sheets from said initial position, away from the stack, engaging the displaced at least one portion of the outer sheet or outer set of sheets with a discharge structure, and discharging said sheet or set of sheets engaged by said discharge structure away from the stack, wherein the pulsed suction is carried out from a position spaced from said initial position of the outer sheet or outer set of sheets only, and wherein air is blown in the direction of said at least one portion of the outer sheet or outer set of sheets of the stack.

* * * * *